US005313748A

United States Patent [19]

Hughes, Jr.

[11] Patent Number: 5,313,748

[45] Date of Patent: May 24, 1994

[54] SECURITY DEVICE FOR SKYLIGHTS AND OTHER VENTS, SHAFTS OR WELLS

[76] Inventor: Richard M. Hughes, Jr., 71-866 Eleanora La., Rancho Mirage, Calif. 92270

[21] Appl. No.: 36,992

[22] Filed: Mar. 24, 1993

[51] Int. Cl.[5] ..... E04B 7/18

[52] U.S. Cl. ..... 52/200; 52/507; 52/106; 49/50

[58] Field of Search ..... 52/200, 507, 95, 96, 52/90.1, 90.2, 640, 641; 49/50; 56/106

[56] References Cited

U.S. PATENT DOCUMENTS

| | | | |
|---|---|---|---|
| 1,055,127 | 3/1913 | Boger . | |
| 1,233,530 | 7/1917 | Whitnell . | |
| 1,986,713 | 1/1935 | Clark . | |
| 2,237,564 | 4/1941 | Keyes | 72/0.5 |
| 2,589,878 | 3/1952 | Shapiro | 292/60 |
| 4,395,861 | 7/1983 | Fipke | 52/727 |
| 4,817,334 | 4/1989 | Badger et al. | 49/55 |

*Primary Examiner*—Carl D. Friedman

*Assistant Examiner*—Creighton Smith

[57] ABSTRACT

The device 30 has a multitude of armature 10A and 10B that when joined with a hinge rod 12 through the elongated tubular head 16A of said armature 10A and 10B and subsequently joined alternately to a series of base rods 14A and 14B through the base hole 18 of said armature 10A and 10B and then anchored to the interior surface or structural studs 28 of a skylight 32 vent or other point of access becomes a formidable entity for discouraging access by unwanted entities. By virtue of an adjustability provided by a multitude of armature 10A and 10B and a hinge rod 12, the device 30 will conveniently fit the interior dimension of a multitude of skylights, vents and other points of access. The device 30 is simple and easy for a user to install. The spacing of said armature 10A and 10B and the subsequent triangulation of the device 30 when installed creates a device that services as a security system which does not create a obtrusive entity neither does it infringe on the elements such as air or light desired by a user.

10 Claims, 1 Drawing Sheet

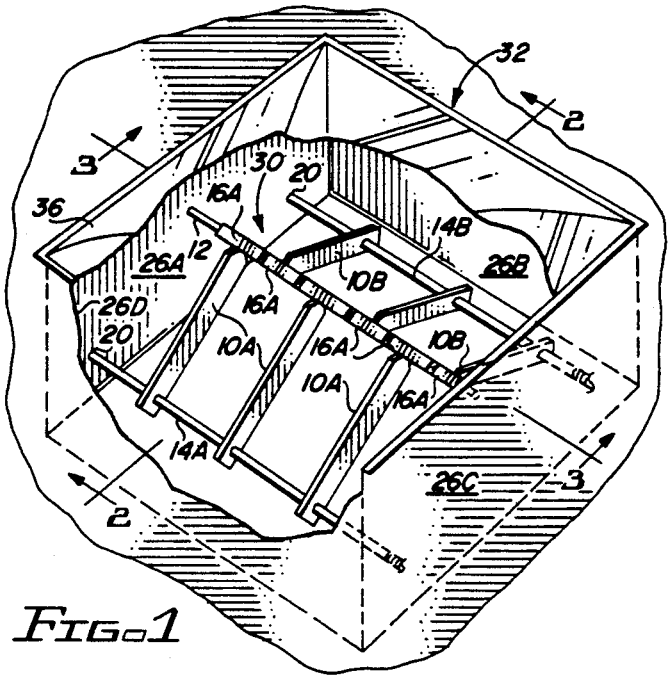
FIG. 1
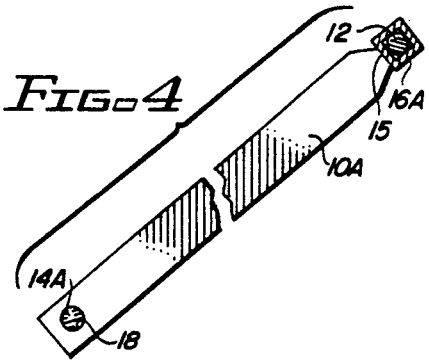
FIG. 4
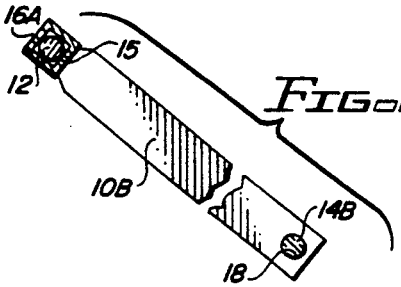
FIG. 5
FIG. 2
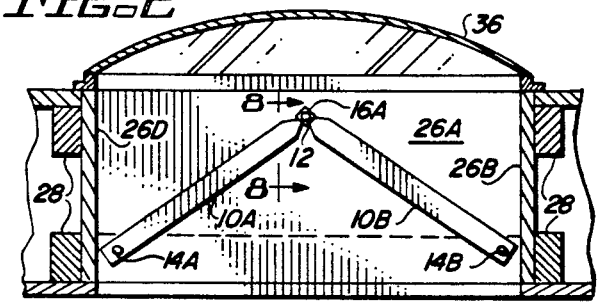
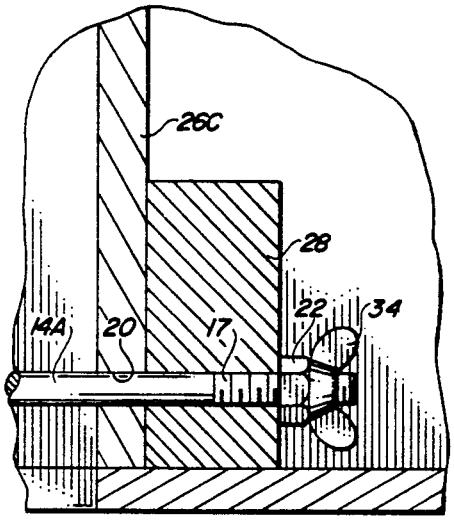
FIG. 6
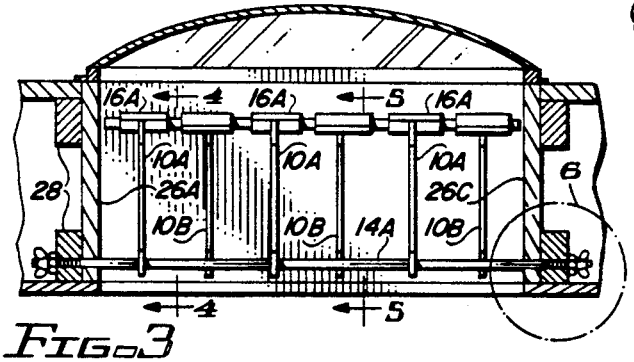
FIG. 3
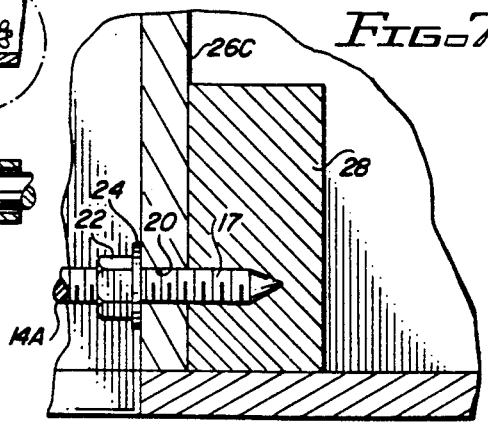
FIG. 7
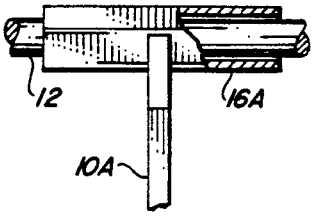
FIG. 8
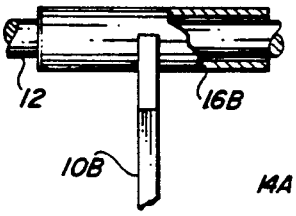
FIG. 9

SECURITY DEVICE FOR SKYLIGHTS AND OTHER VENTS, SHAFTS OR WELLS

BACKGROUND

1. Field of Invention

This invention relates to a security system used to discourage breaking and entry through skylights and other vents, shafts or wells commonly incorporated into residential, commercial, institutional or industrial construction.

2. Description of Prior Art

For many years skylights and other points of access have been a source of breaking and entry. Past attempts to address this problem have incorporated flat barlike grids to cover the point of access.

The points of difference disclosed in these systems have been in regards to the anchoring process for grid systems disclosed in Fipke et.al. U.S. Pat. No. 4,395,861 and the process employed to adjust a grid system relative the interior dimensions of the subject point of access as disclosed in Badger et. al. U.S. Pat. No. 4,817,334 and Shapiro U.S. Pat. No. 2,589,878 and O.H. Boyer U.S. Pat. No. 1,055,127.

A additional area of difference has been the placement of a grid system as regards a subject point of access as disclosed in Whitnell U.S. Pat. No. 123,530 and Keyes U.S. Pat. No. 2,237,564.

SUMMARY OF INVENTION

Objects and Advantages

In order to aid in the understanding of this invention, it can be stated in essentially summary form that it is directed to a security device for a skylight, vent or other points of access. A plurality of armature , each joined to a hinge rod at the elongated tubular head of the armature is anchored alternately by a series of base rods through a hole at the base of the armature and subsequently anchored by means to the side wall or interior surface of the point of access. The security device thereby creates a prohibition to access by unwanted entities.

It is, thus, an object and advantage of this invention to provide a deterrent to breaking and entry by installing said invention within the well of a point of access.

It is a further object and advantage of this invention by virtue of a hinge rod to provide a armature that will adjust to the interior dimension of a multiple of points of access by the utilization of a hinging armature of said invention.

It is a further object and advantage of this invention to provide a inexpensive and reliable device with an adjustability aspect which requires few steps for installation to a user and few and uncomplicated parts.

It is a further object and advantage of this invention to provide a non-obtrusive, aesthetically acceptable means whereby access by unwanted entities will be discouraged and yet the light, air or other elements desirable to a user will not be infringed upon.

Furthermore the device has the additional advantages in that it permits the user to install it with a minimum of time absorbed and tools needed, is in need of minimal maintenance, is not obtrusive in that it is installed within the interior of a point of access, is inexpensive to manufacture, does not prevent desirable elements from penetrating the point of access such as air, light etc.

Other objects and advantages of this invention will become apparent from a study of the following portion of the specification, the claims and the attached drawings.

BRIEF DESCRIPTION OF THE DRAWINGS

FIG. 1 shows a perspective view from the top, partially broken away, of a flat roof skylight including a dome, sidewalls and a shaft or well within which is installed the device showing the armature, hinge rod and base rods.

FIG. 2 shows a section through a side elevation of a skylight with the device installed as seen in view 2/2 of FIG. 1.

FIG. 3 shows a section through a side elevation of a skylight with the device installed as seen in view 3/3 of FIG. 1.

FIG. 4 shows an embodiment of an armature of the device as seen in view 4/4 of FIG. 3.

FIG. 5 shows an embodiment of an armature of the device as seen in view 5/5 of FIG. 3.

FIG. 6 shows an enlarged view of portion 6 of FIG. 3.

FIG. 7 shows an alternate embodiment of an anchoring system as seen in FIG. 6.

FIG. 8 shows an embodiment of an armature elongated tubular head and a hinge rod as seen in view 8/8 of FIG. 2.

FIG. 9 shows an alternate embodiment of an armature elongated tubular head and a hinge rod as seen in view 8/8 of FIG. 2.

DETAILED DESCRIPTION OF THE FIRST PREFERRED EMBODIMENT

FIGS. 1,2,3,4,5,6 and 8

FIG. 1 illustrates the use of the skylight security device 30 according to this invention in a skylight 32 commonly found in residential, commercial, industrial or institutional construction.

According to a preferred embodiment the skylight security device 30 is particularly adapted for use within the shaft, well or vent of a skylight 32 between and within the dome 36 and the sidewalls 26 ABC and D.

In the preferred embodiment of FIGS. 1,2, and 3 a skylight 32 security device 30 is shown. The device 30 embodied is comprised of a multitude of armature 10A and 10B made of cold-rolled flat bar steel in dimensions of $\frac{1}{8}$ inch thick, 1 inch wide, 18 inches in length. The armature 10A and 10B have an elongated tubular head 16A made of cold-rolled steel square tubing in dimensions of 3 inches in length with a interior dimension of 7/16 inches. The armature 10A and 10B also have a base hole 18 of 7/16 inch diameter at the end of armature 10A and 10B opposite the head 16A. The head 16A is fixed or joined to armature 10A and 10B at the neck weld 15, as seen in FIGS. 4 and 5.

Also shown is a hinge rod 12 of cold rolled steel rod with a dimension of $\frac{3}{8}$ inch diameter and of a length equal to or less than the interior dimension of skylight 32 between sidewall 26A and 26C.

FIGS. 1,2, and 3 also show a plurality of base rods 14A and 14B of cold rolled steel rod with a diameter of $\frac{3}{8}$ inches with a length in excess of the outside distance between the studs 28 exterior of and abutting sidewall 26A and 26C.

The parts of device 30 may be formed of a variety of rigid break resistant materials including but not limited to materials such as plastics, reinforced plastics and metals which could include aluminum alloys and mild steel. In the preferred embodiment, cold rolled steel is the selected material, however, any material of sufficient tensile strength will suffice.

It should further be noted that the manufacture of armature 10A and 10B is simple. The armature 10A and 10B can be created by joining a flat bar-like length of steel with the head 16A by virtue of a neck weld 15 and then mechanically punching the base hole 18, as seen in FIGS. 4 and 5. As well, the armature 10A and 10B can be manufactured as a single piece.

As seen in portion 6 of FIG. 3 and FIG. 6 a preferred embodiment for anchoring the device 30 is shown. By the use of a tamper-proof anchor nut 22, such as found through Tamper Proof Screws of Paramount, Calif., and a wing nut 34 of a dimension allowing the anchor nut 22 and wing nut 34 to marry the ⅜ inch diameter of base rods 14A and 14B by using threading 17 of base rods 14A and 14B.

After base rods 14A and 14B are inserted through and within sidewall hole 20, which has a diameter in excess of that of base rod 14A or 14B, anchor nut 22 and wing nut 34 are tightened against a stud or framing 28 of skylight 32.

As seen in portion 6 of FIG. 3, FIG. 7 shows an alternate embodiment of an anchoring system. In this embodiment the device 30 is secured by using a anchor washer 24 and tamper-proof anchor nut 22 secured and tightened to the interior of sidewall 26C. This system would then be employed on all the anchoring points of the device 30.

Additional strength can be added to the anchoring system by the application of any liquid locking material available in the open market such as Loctite 271 Threadlocker, manufactured by Loctite Corporation of Cleveland, Ohio and available in many automotive service and parts stores.

As seen in FIG. 9, an alternate embodiment of head 16A of armature 10A and 10B is shown whereby head 16B, which hinge rod 12 passes through and within, is of a round or circular form.

Operation

The assembly and installation of the device 30 is simple and easy. The interior dimensions of the skylight 32 shaft must be determined. The hinge rod 12 should be of a length minimally less than the interior distance between opposite sidewalls 26A and 26C. The base rods 14A and 14B should be of a length in excess of the exterior distance between studs 28 of the abutting opposite sidewalls 26A and 26C.

Four sidewall holes 20 are manufactured, drilled or punched; two on each opposite sidewall 26A and 26C. The sidewall hole 20 should be of a diameter in excess of the diameter of base rods 14A and 14B. The sidewall holes 20 should be drilled on the same plane.

As seen in FIGS. 1,2 and 3, a multitude of armature 10A and 10B are joined with hinge rod 12 by inserting hinge rod 12 through and within the head 16A of armature 10A and 10B. This will create a free-floating hinge-like component that should span the distance between the opposite sidewalls 26A and 26C. The hinge rod 12 also allows armature 10A and 10B to adjust, by swinging freely, to the potential varying interior dimensions between remaining sidewalls 26B and 26D of skylight 32.

As seen in FIGS. 1,2,4, and 5, the armature 10A and 10B are then joined to respective base rods 14A and 14B by inserting base rods 14A and 14B through and within base hole 18 of the corresponding armature 10A and 10B.

As seen in FIGS. 3 and 6, the device 30 is subsequently secured by inserting base rods 14A and 14B through and within both sidewalls 26A and 26B and framing 28 by using sidewall holes 20.

As seen in FIG. 3, the anchoring of device 30 is accomplished by employing tamper proof anchor nut 22 and wing nut 34. They are secured against the framing 28 and sidewall 26A and 26C of skylight 32 by using the threading 17 of base rods 14A and 14B.

When the armature 10A and 10B, hinge rod 12, base rods 14A and 14B are joined as specified and subsequently inserted through and within sidewall holes 20 and then secured by the anchoring system specified the assembly, installation and operation are accomplished.

It is my theory, although I don't wish to be bound by this, that the triangulated shape of the device 30 reinforces itself in that if downward pressure is exerted on the device 30 by a potential entrant the armature 10A and 10B will press against and into the corresponding sidewall 26A and 26C, thereby creating even more resistance and strength than the device 30 offers independently. If a potential entrant is exerting pressure upward by pulling upward on device 30 the same triangulation will disperse that energy through the armature 10A and 10B to the base rods 14A and 14B, thereby decreasing that energy and increasing the resistance and strength of the device 30, as a whole, above that of the devices' 30 individual parts.

Summary, Ramifications and Scope

Accordingly the reader will see that the device 30 can be installed in a multitude of shafts, wells or vents. The objective of the device 30 is to discourage access to areas by unwanted entities.

In addition, the device 30 can be adjusted to a multitude of differing dimensions of a multitude of shafts, wells or vents by virtue of the adjustability afforded to the device 30 through the hinge rod 12 and the armature 10A and 10B.

Although the description above contains many specifications these should not be construed as limiting the scope of the invention but as merely providing illustrations of some of the presently preferred embodiments of this invention.

This invention has been described in its presently contemplated best mode, and it is clear that it is susceptible to numerous modifications, modes and embodiments within the ability of those skilled in the art and without the exercise of the inventive faculty.

Accordingly, the scope of this invention is determined by the scope of the appended claims and their legal equivalents rather than by the examples given herein.

What is claimed is;

1. A security device to discourage breaking and entry through vents, shafts, wells and other points of access, said device comprising:

a. a multitude of armature means for obstructing access, said armature means having an elongated connector head for receiving a hinge support means said armature means having a base hole means for receiving a base support means said armature means being of substantially equal dimensions and form;

b. at least one hinge support means of sufficient length to span interior distance between opposite sidewalls of said point of access, said hinge support means being of sufficient diameter to be received through said head of said armature means;

c. a plurality of base support means of sufficient length for anchoring to opposite sidewalls, said base support means being received through said base hole of said armature means, said base support means being secured to said sidewalls on a plane different of said hinge support means within said shaft;

d. a means for securing said base support means to said opposite sidewalls.

2. A security device as set forth in claim 1 wherein said hinge support means passes through said head of each of said armature means and spans the interior distance between said opposite sidewalls, each said hinge support means being a free-floating component inside said head of said armature, said armature means by virtue of said hinge support means being adjustable freely to a multitude of differing distances between said sidewalls.

3. A security device as set forth in claim 1 wherein said base support means passes through each of said armature means through said base hole so that the distance between said base support means can be adjusted to adjacent said sidewalls so that said device will by said hinging means fit a multitude of potentially differing interior dimensions of said shafts.

4. A security device as set forth in claim 1 wherein said base support means when joined with said means for securing to said opposite sidewall fixes the position of said base supports and fixes the position of said hinge support so that said device is a formidable deterrent to passage through said shaft discouraging unwanted entities access thereto.

5. A security device as set forth in claim 1 wherein said base support means are rods and said securing means are attached to said base support rods and extend through sidewall holes in the point of access and secured by means of stop on said shafts against said opposite sidewalls whereby said securing means are not accessible from inside said point of access to unwanted entities so that said device is thereby secured.

6. A security device as set forth in claim 1 wherein said device is installed within a shaft, having a skylight and ceiling panel, the device is placed between said skylight and ceiling panel so as to be visually hidden to lines of sight outside said shaft.

7. A security device comprising;

first and second base rods, said base rods being for attachment in a passage having sidewalls, said rods being attached adjacent said sidewalls;

a plurality of armatures, each of said armatures having a first end and a second end, said first end of each of said armatures having an opening there through, said base rods extending through said openings in said first end of said armatures, said armatures each having an opening through said second end of said armatures;

a hinge rod extending through said openings in each of said armatures adjacent said second end thereof, the distance between said base rods being less than twice the distance between said openings of said first and second ends of said armatures so that said hinge rod lies out of the plane of said base rods;

means for holding said armatures in spaced positions so that when installed in a shaft, said shaft is obstructed to passage.

8. The security device of claim 7 wherein said means for holding said armatures in spaced conditions comprise a tube on one of said rods positioned between each of said armatures so as to maintain said armatures in spaced position.

9. The security device of claim 8 wherein a spacing tube is secured to each of said armatures.

10. The security device of claim 7 wherein said base rod is sufficiently long to extend through the walls of said shaft and said base rod carries attachment means thereon outside of said walls of said shaft.

* * * * *